US005830535A

United States Patent [19]

Junius et al.

[11] Patent Number: 5,830,535

[45] Date of Patent: Nov. 3, 1998

[54] PROCESS FOR PRODUCING A SKI EDGE

[75] Inventors: Hans-Toni Junius, Iserlohn; Heinz Höfinghoff, Schalksmühle, both of Germany

[73] Assignee: C. D. Wälzholz Produktions-Gesellschaft mbH, Hagen, Germany

[21] Appl. No.: 776,201

[22] PCT Filed: Jul. 14, 1995

[86] PCT No.: PCT/EP95/02769

§ 371 Date: Jan. 10, 1997

§ 102(e) Date: Jan. 10, 1997

[87] PCT Pub. No.: WO96/02305

PCT Pub. Date: Feb. 1, 1996

[30] Foreign Application Priority Data

Jul. 15, 1994 [DE] Germany ..... 44 24 979.9

[51] Int. Cl.[6] ..... B05D 3/12

[52] U.S. Cl. ..... 427/327; 280/608; 148/537; 427/377; 427/388.1

[58] Field of Search ..... 280/608; 148/516, 148/537; 427/327, 377, 388.1

[56] References Cited

U.S. PATENT DOCUMENTS 4,330,574 5/1982 Pierson et al. ..... 427/319
4,477,285 10/1984 Ault ..... 134/3
5,451,276 9/1995 Junius ..... 148/632

FOREIGN PATENT DOCUMENTS 0031399 7/1981 European Pat. Off. .
2165085 8/1973 France .
2453881 11/1980 France .
2562562 11/1985 France .
2204270 8/1972 Germany .

*Primary Examiner*—Erma Cameron
*Attorney, Agent, or Firm*—Collard & Roe, P.C.

[57] ABSTRACT

A process is for producing a ski edge for incorporation into a ski consisting of rolled and heat-treated material, at least part of the surface of which is coated with a bonding agent. In order to reduce the labour and expense and environmental pollution in the production of ski edges and improve the reliability of the bond between the edges and body of the ski, the ski edge strip material is coated with the bonding agent (primer) at least in the region of the bonding surfaces in a continuous process following the heat treatment. Thus, the ski edge strip material is kept under reducing conditions directly before coating in such a way that the surface of the strip material is free of oxide before coating.

12 Claims, 2 Drawing Sheets

PROCESS FOR PRODUCING A SKI EDGE

The invention relates to a process for producing a ski edge from rolled and heat-treated material, such ski edge being prepared for incorporation in a ski and at least partly coated on its surface with a bonding agent (primer).

According to the state of the art, for the manufacture of ski edges, a steel strip profile is rolled first, which profile is subsequently hardened and tempered, i.e., it is heat-treated. For the purpose of avoiding phenomena of corrosion due to oxidation (rust) during transport and storage of such ski edge strip profiles, which are commercially traded as semi-finished metal products, said strip profiles are coated with protective, anticorrosive oil. Prior to or after such coating, recesses and/or openings are punched in the flank of the strip profile, if need be.

As a rule, the ski edges are further processed by the ski manufacturer. There, the protective, anticorrosive oil serving as protection against corrosion is removed first. Subsequently, the ski edge strip profile is sandblasted in order to mechanically detach the oxide skins formed. Thereafter, the ski edge is coated with a bonding agent (primer), embedded in the plastic body of the ski, and bonded.

The requirements to be met by the durability of the connection between the edge of the ski and the body of the ski are very high. Particularly in connection with the so-called monoskis or snowboards, the edges of the ski are highly stressed because with said sport equipment, as opposed to conventional skis, one single ski edge must absorb all dynamic forces occurring when such equipment is used. With skis for competitive sport, the requirements to be met are similarly high. This condition has to be taken into account in the manufacture of the ski edge by applying the bonding agent to the ski edge strip profile under optimal conditions. It is absolutely necessary for said purpose that the steel strip profile is free of oxide to the greatest possible extent, and that the protective, anticorrosive oil is removed free of any residue. Usually, suitable solvents are used for the degreasing, and oxide skins or other corrosions are eliminated by sandblasting or the like.

An important drawback of said known process for the production of a ski edge lies in the fact that the ski edge strip material, which is supplied to the ski manufacturer as a semi-finished product, has to be prepared with relatively high production-technical expenditure before it is incorporated in the ski. The removal of layers of corrosion, i.e., of the oxide skin by means of sandblasting or the like, as well as the use of solvents for removing the anticorrosive oil both translate into a relatively high expenditure in terms of labor, time and cost. Furthermore, the use of solvents, which are chlorinated hydrocarbons, as a rule, is particularly harmful to the environment, both in view of the solvent vapors escaping during the manufacturing process , and in connection with the disposal of the solvent, the latter being contaminated with protective, anticorrosive oil.

From the above results the problem of the invention to further develop a process according to the introductory part of the main claim in a way such that the labor and cost expenditures in the manufacture of the ski edge as well as the load on the environment are reduced and a more solid bond of the ski edge with the body of the ski is made possible at the same time.

For solving said problem, the invention proposes that the ski edge strip material is, in a continuous work operation following the heat treatment, coated at least within the zone of the bonding surfaces with the bonding agent (primer), whereby the ski edge strip material is maintained under reducing conditions directly before coating in such a way that the surface of the strip material is free of oxide before the coating.

In the process according to the invention, the time- and labor-intensive mechanical removal of oxide skins is dispensed with completely. A further advantage results from the fact that the primer coating applied to the metallically blank metal serves at the same time as a protective anticorrosive coating. In this way, the application of protective anticorrosive oil or the like to the ski edge strip profile prior to storage and transport to the ski manufacturer becomes superfluous. The labor- and time-intensive as well as environmentally harmful degreasing of the strip material is consequently dispensed with as well.

Furthermore, it is particularly advantageous that the primer coating in the process according to the invention adheres to the ski edge strip profile in a particularly solid and uniform way because in said process, neither residues of protective, anticorrosive oil or corrosion residues impair the homogeneity of the surface of the material. To this extent, the connection of ski edge strip profiles produced according to the process of the invention with the body of the ski is particularly solid and reliable, which makes such strip profiles especially suitable for use in the manufacture of snowboards and monoskis or other skis, for example slalom skis highly stressed along the edge.

The bonding agents used can be adapted without any problem to the ski edge material and the material of the basic body of the ski, which in most cases is PU-foam material or epoxy laminate. Furthermore, the thickness of the primer coating applied to the edge of the ski can be predetermined in the process according to the invention in a defined way. This makes it possible to form the primer coating with adequate thickness, so that the joint of the bond is sealed. Penetration of moisture through the joint of the bond and into the body of the ski is reliably prevented in this way. Damage caused by sweat water is largely excluded in this way, and the durability of ski bodies consisting of, for example PU-foam, is clearly prolonged.

In connection with a preferred implementation of the process according to the invention, tempering of the ski edge strip material after hardening takes place in an atmosphere adjusted in a reducing way. During tempering, the strip profile is heated to temperatures below the structure transformation temperature. If, in this connection, the strip profile is passed through a reducing gas atmosphere, for example through an $H_2$—$N_2$-mixture, no oxide can form, and even minor oxide residues on the surface are removed by the reduction process. Thereafter, the surface is practically free of oxide.

In connection with the process according to the invention, the ski edge strip material, following hardening and tempering, is alternatively passed through a reducing pickling bath. With said procedure too, oxide-free surfaces are obtained because a reduction process takes place on the surface in this case as well. For practical implementation, a pickling bath for continous run-through can be simply incorporated in existing production plants.

According to an advantageous further development of the process according to the invention, provision is made that the ski edge strip material is provided with punch-outs after the bonding agent (primer) has been applied. Such punch-outs serve the purpose of anchoring the ski edge more solidly in the body of the ski and are normally punched in a flank of the strip profile by means of suitable dies. During punching, the bonding agent coating acts as a lubricating agent. This clearly prolongs the tool life of the punching tool, which significantly reduces the maintenance expenditure and, overall, results in a more rational manufacture.

It is advantageous, furthermore, if the ski edge strip material is pickled in a pickling bath prior to coating with the bonding agent. With such an additional process step, which is interconnected in the course of the production between the hardening and the primer coating steps, the advantages of the process according to the invention are applicable even to ski edge materials which are difficult to handle. For example, scaling, which occasionally occurs during hardening, is eliminated free of residue.

For special cases of application, it may be advantageous to roughen the ski edge strip material at least on the bonding surfaces before coating it with the bonding agent (primer). In this connection, the surface of the bonding area is roughened or structured in a defined way by sandblasting or pearlblasting or other methods. A surface roughened in this way promotes an even more solid adhesion of the primer on the ski edge strip material, on the one hand, and also enhances the anchoring of the ski edge in the ski by means of the bond, on the other hand.

According to an advantageous technical development of the process of the invention, provision is made that the process steps prior to the coating of the ski edge strip material with the bonding agent take place in an inert-gas atmosphere ($H_2$—$N_2$). By this measure, any oxidation in the course of the production process is safely reduced. Such a development is possible with the modern continuous heat treatment plants used.

The process according to the invention is explained in greater detail in the following by reference to the drawings, which in detail show the following:

BRIEF DESCRIPTION OF THE DRAWINGS

FIG. 1 schematically shows a continuous production plant for ski edge strips profiles. In said installation, a profile rolling mill with a connected hardening furnace is shown combined in a block in a simplified way and denoted by the reference numeral 1. In the drawing, blank, oxide-free ski edge strip profile 2 exits from the outlet of the hardening furnace 1 in the direction of the arrow, i.e., from the left to the right.

Figure 1:
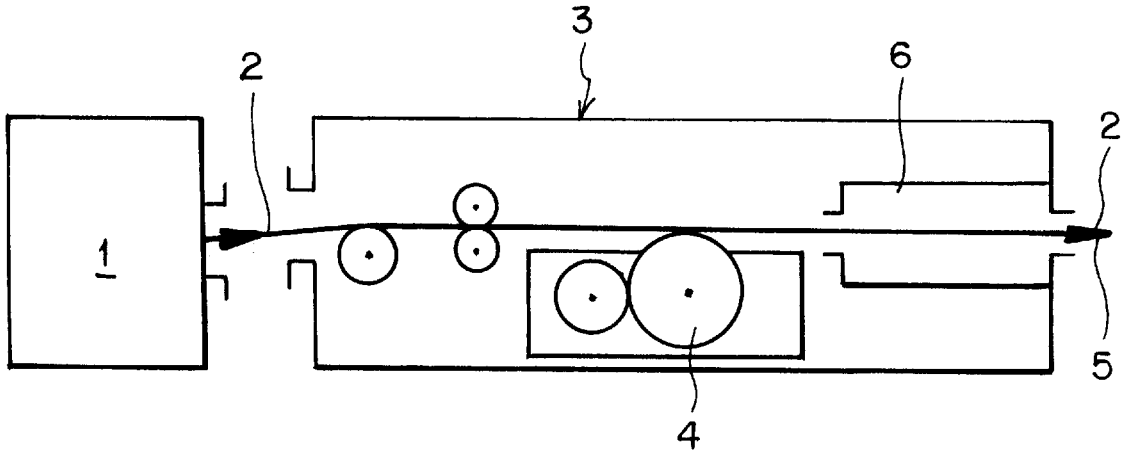
FIG. 1 schematically shows a device for carrying out the process according to the invention.

A primer coating plant is arranged directly following the hardening furnace 1, said coating plant being denoted as a whole by the reference numeral 3. The ski edge strip profile 2 exiting from the hardening furnace 1 enters into the coating plant 3 and is passed in the latter across a coating roll 4. A primer coating 5 is applied to the ski edge strip profile 2 by means of said roll.

In the running direction downstream of the coating roll 4, the ski edge strip profile 2 passes through a temperature-controlled drying chamber 6, in which the primer coating 5 is cured.

In the primer coating plant 3, the ski edge strip profile 2 is kept under a reducing-gas atmosphere—for example $H_2N_2$—up to directly upstream of the coating roll 4. This is not shown in detail in the drawing.

The practical realization of the reducing-gas atmosphere takes place by flooding the passage zone of the ski edge strip profile 2 with reducing gas.

The ski edge strip profile 2 coated with the primer coating 5, said strip profile exiting in the drawing to the right, is now ready for further processing and, if need be, can be coiled on a winding spool not shown.

Figure 2:
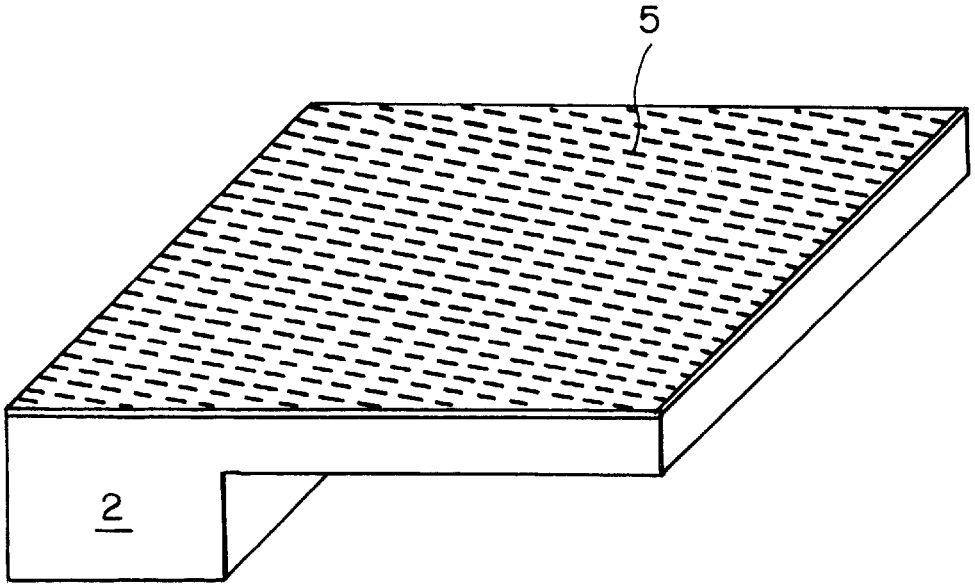
FIG. 2 shows a ski edge strip profile coated with bonding agent (primer) in accordance with the invention.

FIG. 2 shows a section of the ski edge strip profile 2 coated by means of the primer coating plant 3 shown in FIG. 1. The primer coating 5 covers the bonding surface of the ski edge strip profile 2 and is shown shaded.

Figure 3:
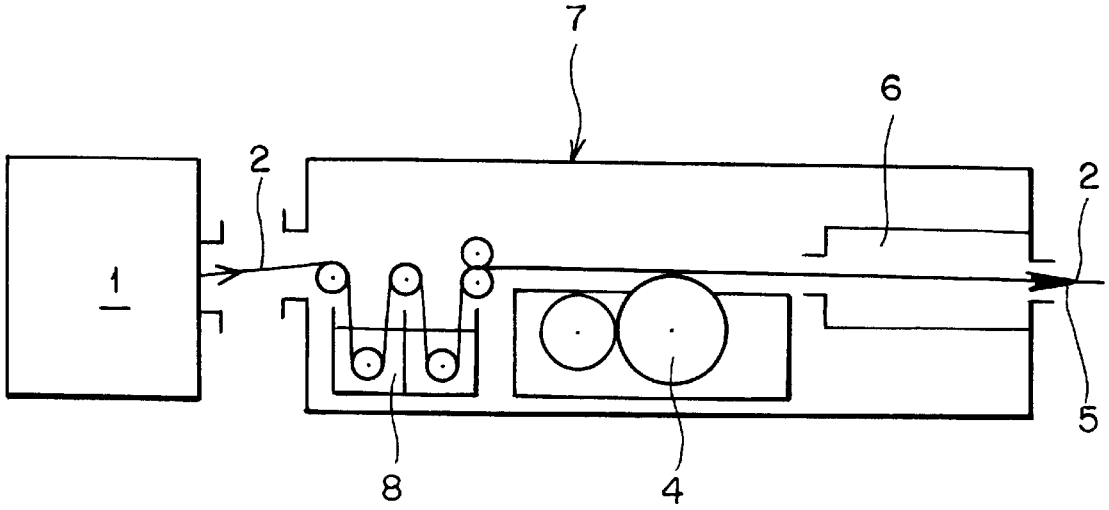
FIG. 3 schematically shows a device for carrying out the process of the invention by a second way of implementation.

FIG. 3 shows a second embodiment or a primer coating plant with the same representation as the one in FIG. 1, said plant being denoted by the reference numeral 7. Here, identical components are denoted by the same reference symbols as the ones used in FIG. 1.

As compared to the primer coating plant 3 shown in FIG. 1, the difference here is that the ski edge strip profile passes in the primer coating plant 7 through a reducing continuous pickling bath 8 which, in the running direction, is arranged upstream of the coating roll 4. The continuous pickling bath 8 is filled here with pickling and neutralizing agents, which are known per se.

If need be, the primer coating plant 7 can be flushed with inert gas in order to effectively prevent oxidation following pickling in the continuous pickling bath 8.

The ski edge strip profile 2 produced according to the process of the invention and provided with a primer coating 5 now can be incorporated by bonding in a ski body by the ski manufacturer, whereby the primer coating 5 adheres particularly solidly to the ski edge strip profile 2 and, at the same time, serves as protection against corrosion. Therefore, further working of the surface of the material prior to incorporation the ski is no longer required.

We claim:

1. Process for producing a ski edge from a rolled and heat treated steel where the steps in the process are hardening of the steel;

tempering of the steel; and coating of a surface of the steel ski edge with a bonding agent, where before the coating the steel ski edge is treated in a way, that present existing oxide is removed and oxide-development-formation is inhibited, such that the steel ski edge is free of oxide prior to the coating.

2. Process according to claim 1, wherein said tempering of the steel ski edge following hardening, takes place in a reducing atmosphere.

3. Process according to claim 1, wherein after hardening and tempering, the steel ski edge is passed through a reducing pickling bath.

4. Process according to claim 1, wherein after coating of the bonding agent, the steel ski edge is provided with punch-outs.

5. Process according to claim 1, wherein prior to coating with the bonding agent, the steel ski edge is blasted with blasting agent at least on bonding surfaces.

6. Process according to claim 1, wherein the process steps prior to coating of the steel ski edge with the bonding agent takes place in an inert-gas atmosphere.

7. Process for producing a ski edge from a rolled and heat treated steel where the steps in the process are hardening of the steel;

tempering of the steel in $H_2$—$N_2$;

coating of a surface of the steel ski edge with a bonding agent, where before the coating the steel ski edge is maintained in a $H_2$—$N_2$ atmosphere, such that the steel ski edge is free of oxide prior to the coating.

8. Process according to claim 7, wherein tempering of the steel ski edge following the hardening, takes place in a reducing atmosphere.

9. Process according to claim 7, wherein after hardening and tempering, the steel ski edge is passed through a reducing pickling bath.

10. Process according to claim 7, wherein after coating of the bonding agent, the steel ski edge is provided with punch-outs.

11. Process according to claim 7, wherein prior to coating with the bonding agent, the steel ski edge is blasted with blasting agent at least on the bonding surfaces.

12. Process according to claim 7, wherein the process steps preceding coating of the steel ski edge with the bonding agent takes place in an inert-gas atmosphere.

* * * * *